US011117381B2

(12) United States Patent
Nagamatsu

(10) Patent No.: US 11,117,381 B2
(45) Date of Patent: Sep. 14, 2021

(54) PRINTER

(71) Applicant: SEIKO EPSON CORPORATION, Tokyo (JP)

(72) Inventor: Shoichi Nagamatsu, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/815,789

(22) Filed: Mar. 11, 2020

(65) Prior Publication Data

US 2020/0290361 A1 Sep. 17, 2020

(30) Foreign Application Priority Data

Mar. 13, 2019 (JP) ..... JP2019-045631

(51) Int. Cl.
*B41J 2/175* (2006.01)
*B41J 2/165* (2006.01)
*B41J 29/02* (2006.01)

(52) U.S. Cl.
CPC ..... *B41J 2/1752* (2013.01); *B41J 2/16508* (2013.01); *B41J 29/02* (2013.01)

(58) Field of Classification Search
CPC ..... B41J 2/1752; B41J 2/16508; B41J 29/02; B41J 2/16511
USPC ..... 347/86
See application file for complete search history.

(56) References Cited

U.S. PATENT DOCUMENTS 6,517,269 B1 * 2/2003 Scholz ..... B41J 2/16508 347/29

FOREIGN PATENT DOCUMENTS

| | | |
|---|---|---|
| JP | H05-147313 | 6/1993 |
| JP | 2001-270097 | 10/2001 |
| JP | 2010-188700 | 9/2010 |
| JP | 2016-104569 | 6/2016 |

* cited by examiner

*Primary Examiner* — Huan H Tran
*Assistant Examiner* — Alexander D Shenderov
(74) *Attorney, Agent, or Firm* — Workman Nydegger

(57) ABSTRACT

A printer includes a platen that supports a print medium, an ejection head that ejects a liquid as a droplet toward the supported print medium, a carriage that mounts the ejection head, a guide shaft that movably supports the carriage, a first frame, and a second frame disposed opposite to the first frame. One end portion of the guide shaft is fixed to the first frame and another end portion of the guide shaft is fixed to the second frame. One end portion of the platen in a direction along the guide shaft is fixed to the first frame and another end portion of the platen in the direction along the guide shaft is fixed to the second frame.

7 Claims, 6 Drawing Sheets

PRINTER

The present application is based on, and claims priority from JP Application Serial Number 2019-045631, filed Mar. 13, 2019, the disclosure of which is hereby incorporated by reference herein in its entirety.

BACKGROUND

1. Technical Field

The present disclosure relates to a printer.

2. Related Art

A printer including a platen to support a print medium, a carriage mounting a printing head, and a guide shaft supporting the carriage has heretofore been known as described in JP-A-2010-188700, for example.

However, in the above-mentioned printer, the plate and the guide shaft are supported by different sections of the frame. For this reason, when the printer receives vibration, an impact, and the like during its transportation, for example, the section of the frame supporting the platen and the section of the frame supporting the guide shaft are deformed independently of each other. As a consequence, this configuration causes a problem that an interval between the platen and the guide shaft is not kept constant, or in other words, that an interval between an ejection head and the platen is not kept constant.

SUMMARY

A printer according to an aspect of the present disclosure includes a platen that supports a print medium, an ejection head that ejects a liquid as a droplet toward the supported print medium, a carriage that mounts the ejection head, a guide shaft that movably supports the carriage, a first frame, and a second frame disposed opposite to the first frame. One end portion of the guide shaft is fixed to the first frame and another end portion of the guide shaft is fixed to the second frame. One end portion of the platen in a direction along the guide shaft is fixed to the first frame and another end portion of the platen in the direction along the guide shaft is fixed to the second frame.

The printer may include a cap disposed in a first region between the first frame and the second frame and configured to cover a nozzle surface of the ejection head to eject the droplet. Here, the cap and the platen may be disposed in an overlapping manner when the platen is viewed sideways.

The printer may include a cap disposed in a second region, which is a region different from a first region between the first frame and the second frame and is provided in a direction of extension of the guide shaft, and configured to cover a nozzle surface of the ejection head to eject the droplet. Here, the carriage may include an offset portion configured to displace a position of the nozzle surface of the ejection head in a direction toward the second region relative to a position of a portion of the carriage supported by the guide shaft. The nozzle surface may be located in the second region in a state where the nozzle surface is covered with the cap.

In the printer, a rigidity of the guide shaft may be equal to a rigidity of the platen.

DESCRIPTION OF EXEMPLARY EMBODIMENTS

1. First Embodiment

Figure 1:
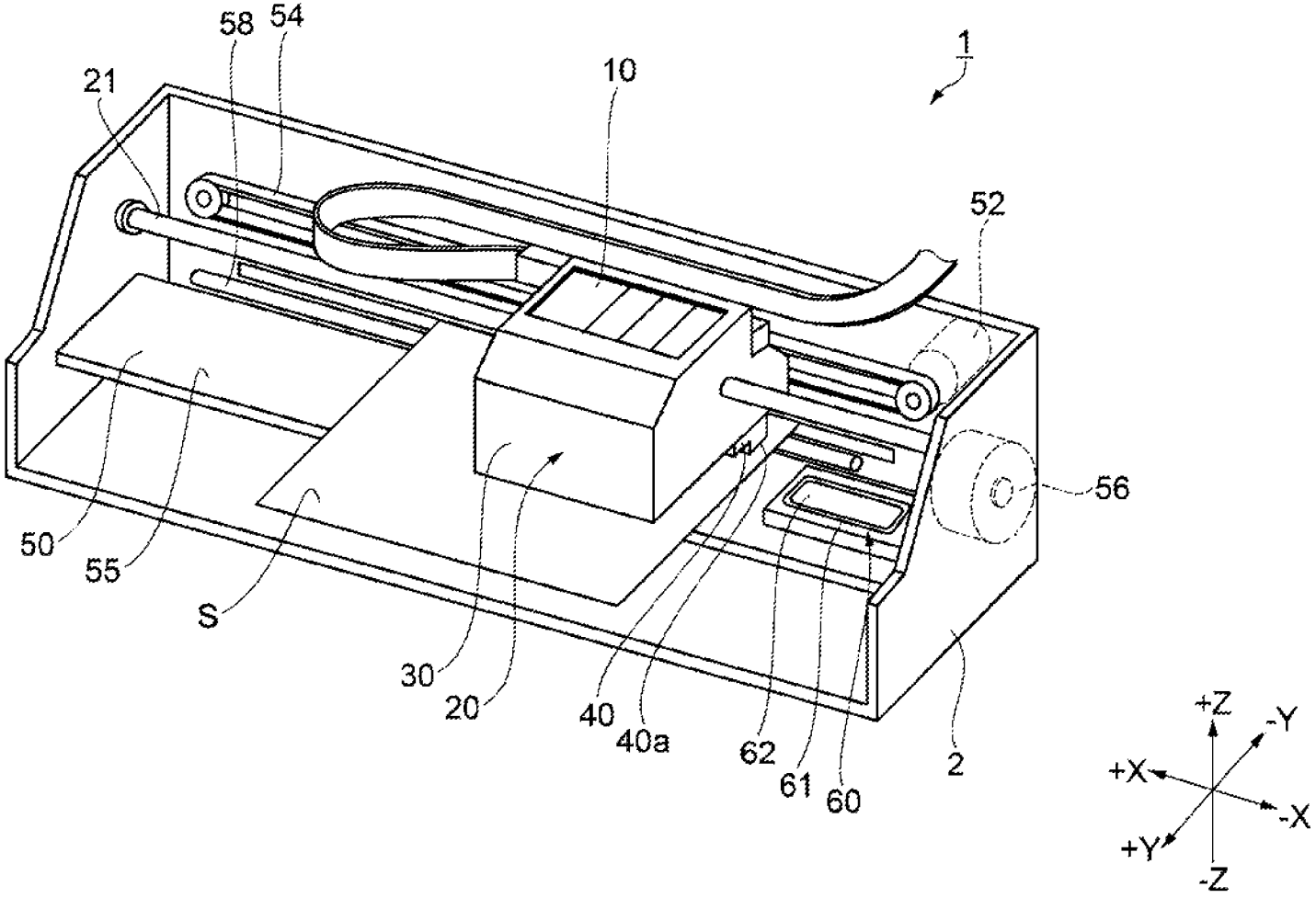
FIG. 1 is a perspective view showing a configuration of a printer according to a first embodiment.

A configuration of a printer 1 will be described to begin with. FIG. 1 is a perspective view showing a configuration of the printer 1. The printer 1 is an ink jet printer that can print on a sheet S as a print medium. As shown in FIG. 1, the printer 1 includes a body frame 2. The body frame 2 is formed into a box shape and constitutes an external form of the printer 1. A carriage 20, a platen 50, and the like are disposed in the body frame 2.

The carriage 20 includes an attachment portion 30. Moreover, the carriage 20 mounts an ejection head 40. The carriage 20 is movably supported by a guide shaft 21. The guide shaft 21 is formed into a columnar shape and extends in a direction along X axis. The carriage 20 is supported by the guide shaft 21 so that the carriage 20 can reciprocate in +X direction and −X direction along the X axis.

The attachment portion 30 is configured to be capable of attaching and detaching a cartridge 10 that can store an ink as a liquid. One or more cartridges 10 may be attached to the attachment portion 30. In this embodiment, four cartridges 10 are detachably attached to the attachment portion 30. The cartridges 10 store four types of inks such as a black ink, a yellow ink, a magenta ink, and a cyan ink, respectively. Each cartridge 10 is attached to the attachment portion 30 in such a way as to be put into a liquid introduction needle provided to the attachment portion 30. Thus, the ink stored in the cartridge 10 is supplied to the ejection head 40 through the liquid introduction needle.

The ejection head 40 includes multiple nozzles and ejects the ink as droplets from the respective nozzles. The ejection head 40 includes piezoelectric elements, for example, as ink ejection mechanisms and the ink is ejected from the respective nozzles by driving the piezoelectric elements. The ejection head 40 of this embodiment can eject the aforementioned four types of inks with different colors. The ejection head 40 is held by the carriage 20 while orienting its nozzle surface 40*a* to eject the inks in −Z direction.

Meanwhile, the printer 1 includes a main scan feeding mechanism and a vertical scan feeding mechanism which move the carriage 20 and a sheet S relative to each other.

The main scan feeding mechanism includes a carriage motor 52 and a driving belt 54. The carriage 20 reciprocates along the guide shaft 21 by transmitting power from the carriage motor 52 to the carriage 20 through the driving belt 54. The vertical scan feeding mechanism includes a transport motor 56 and a driving roller 58, and transports the sheet S in +Y direction by transmitting power from the transport motor 56 to the driving roller 58. The sheet S is transported to the platen 50 by the vertical scan feeding mechanism. The transported sheet S is supported on a support surface 55 of the platen 50.

The platen 50 is formed into a plate and has a substantially rectangular shape in plan view. The support surface 55 of the platen 50 forms a substantially flat surface. The support surface 55 of the platen 50 is disposed opposite to the nozzle surface 40*a*. Then, characters, figures, images, and the like are printed on the sheet S supported on the support surface 55 of the platen 50 by ejecting the inks from the ejection head 40 onto the sheet S.

The printer 1 also includes a cleaning portion 60. The cleaning portion 60 of this embodiment is provided on the −X direction side relative to a region of the platen 50 to which the sheet S is to be transported. The cleaning portion 60 is configured to perform a variety of maintenance work on the ejection head 40. The cleaning portion 60 includes a capping portion 61. The capping portion 61 includes a cap 62 provided with a recess. The capping portion 61 is provided with a hoisting and lowering mechanism including a not-illustrated driving motor, and is configured to be capable of moving the cap 62 along Z axis. Moreover, when the printer 1 is not in operation, the nozzle surface 40*a* to eject the inks from the ejection head 40 is brought into close contact and covered with the cap 62. Thus, the cap 62 prevents the occurrence of problems including clogging of the nozzles with the dried inks.

Moreover, the cleaning portion 60 has a function to clean the nozzles. Specifically, a nozzle may be clogged if the ink is not ejected from the nozzle for a long time or if a foreign material such as paper dust adheres to the nozzle. In this case, the ink is forcibly suctioned out of the nozzle by using a suctioning device such as a pump not illustrated therein in a state of bringing the cap 62 into close contact with the nozzle surface 40*a*. In this way, the foreign material inside the nozzle is removed. Meanwhile, on the part of the cleaning portion 60, the ink is ejected from the nozzle toward the recess of the cap 62. In other words, the nozzle is cleaned by carrying out flushing, and an ejecting condition of the nozzle can thus be ameliorated.

Figure 2:
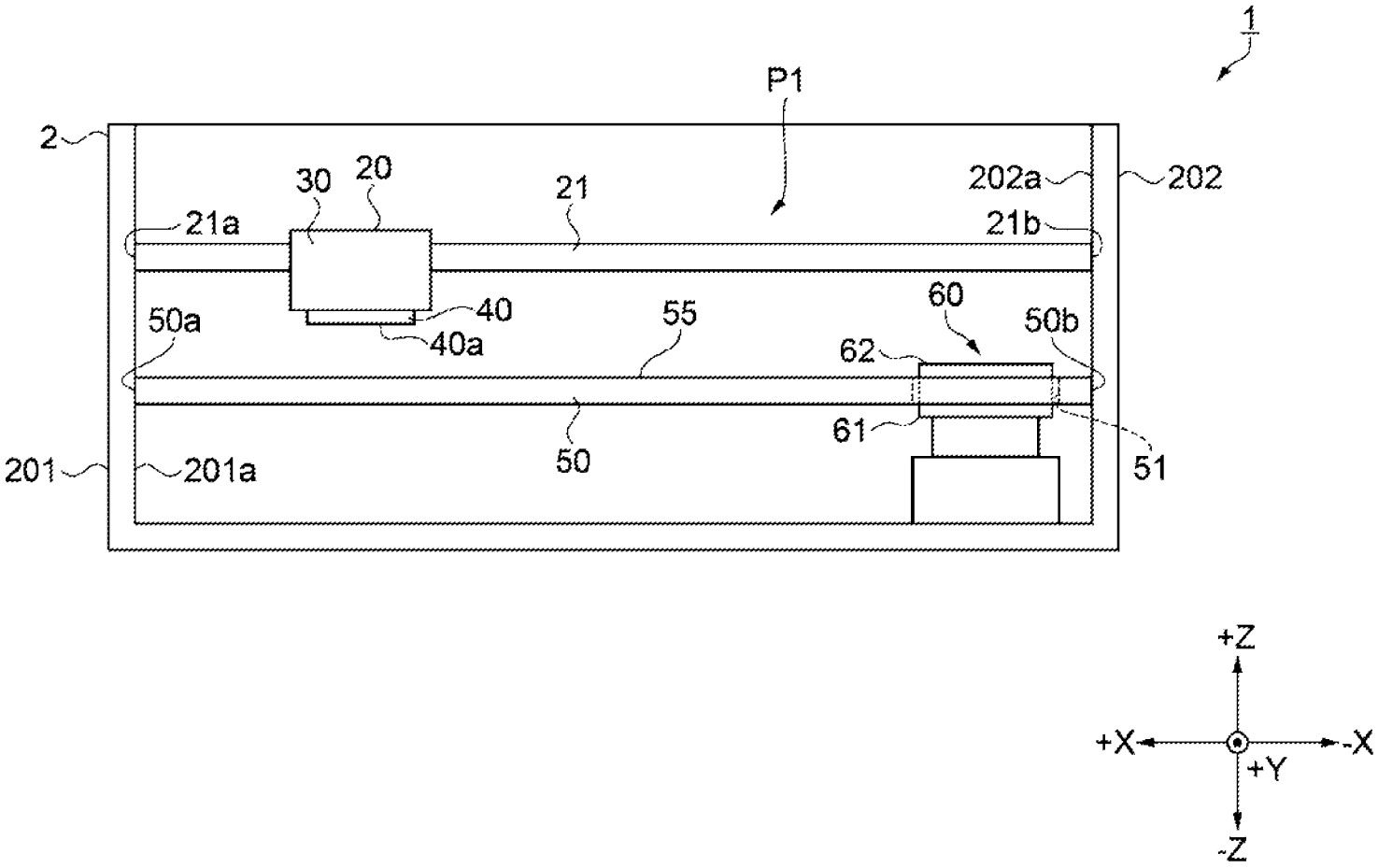
FIG. 2 is a schematic front view showing the configuration of the printer according to the first embodiment.

Next, a description will be given of detailed configurations of the guide shaft 21, the platen 50, the cap 62, and so forth. FIG. 2 is a schematic front view showing the configuration of the printer 1 and FIG. 3 is a schematic plan view showing the configuration of the printer 1.

Figure 3:
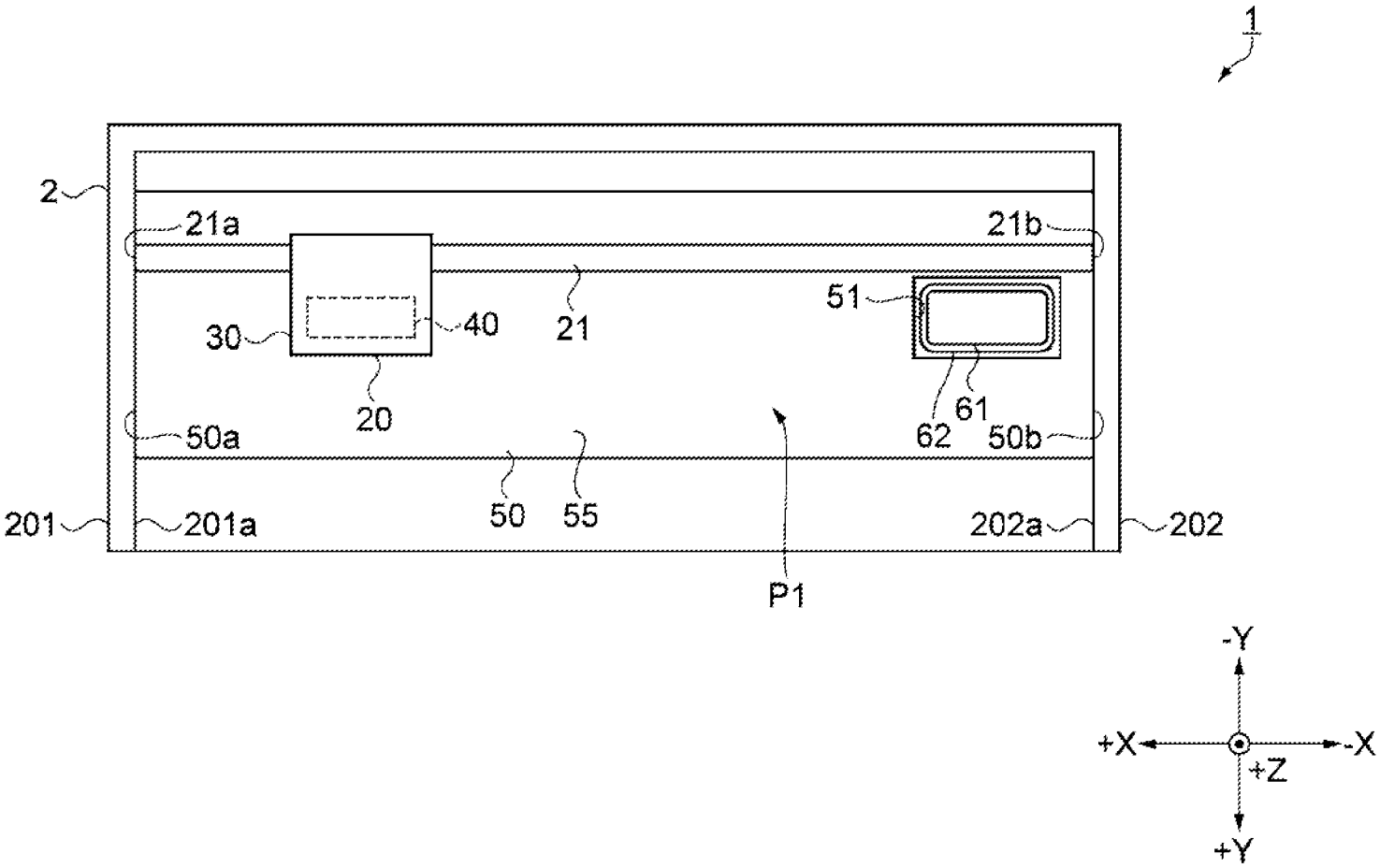
FIG. 3 is a schematic plan view showing the configuration of the printer according to the first embodiment.

As shown in FIGS. 2 and 3, the printer 1 includes a first frame 201 and a second frame 202. In this embodiment, the first frame 201 and the second frame 202 constitute part of the body frame 2. To be more precise, the printer 1 includes the first frame 201 provided at an end portion in the +X direction of the body frame 2 and the second frame 202 provided at an end portion in the −X direction of the body frame 2. The first frame 201 and the second frame 202 are each formed into a plate, opposed to each other, and disposed substantially parallel to each other.

One end portion 21*a* in the +X direction of the guide shaft 21 is fixed to an inner side surface 201*a* on the −X direction side of the first frame 201. Meanwhile, another end portion 21*b* in the −X direction of the guide shaft 21 is fixed to an inner side surface 202*a* on the +X direction side of the second frame 202. On the other hand, one end portion 50*a* of the platen 50 in a direction along the guide shaft 21, that is, in a direction along the X axis, is fixed to the inner side surface 201*a* of the first frame 201. Meanwhile, another end portion 50*b* of the platen 50 in the direction along the guide shaft 21, that is, in the direction along the X axis, is fixed to the inner side surface 202*a* of the second frame 202. In other words, the one end portion 21*a* of the guide shaft 21 and the one end portion 50*a* of the platen 50 are fixed to the first frame 201, while the other end portion 21*b* of the guide shaft 21 and the other end portion 50*b* of the platen 50 are fixed to the second frame 202. That is to say, the guide shaft 21 and the platen 50 are fixed to the first frame 201 and the second frame 202 that are paired frames identical to each other.

In this embodiment, the guide shaft 21 and the support surface 55 of the platen 50 are disposed substantially parallel to each other. Meanwhile, a distance dimension between the one end portion 21*a* and the other end portion 21*b* of the guide shaft 21 is substantially equal to a distance dimension between the one end portion 50*a* and the other end portion 50*b* of the platen 50 in the direction along the guide shaft 21.

Here, a rigidity of the guide shaft 21 may be substantially equal to a rigidity of the platen 50. In this case, a material of the guide shaft 21 and a material of the platen 50 may be the same or may be different from each other. Examples applicable to the materials of the guide shaft 21 and the platen 50 include metallic materials, resin materials, and composite materials thereof. In the meantime, respective shapes of the guide shaft 21 and the platen 50 may be appropriately set so as to equalize the rigidities thereof. Moreover, a rigidity of the first frame 201 may be substantially equal to a rigidity of the second frame 202. In this case, the first frame 201 and the second frame 202 may be made of the same material and have substantially the same shape.

In the meantime, the cap 62 of the cleaning portion 60 of this embodiment is disposed in a first region P1 between the first frame 201 and the second frame 202 and on the −X direction side of the platen 50. To be more precise, the cap 62 is disposed on the −X direction side relative to a printing region of the platen 50 where the sheet S is possibly supported. A through hole 51 is provided in a portion of the platen 50 and the cap 62 is disposed at a position corresponding to the through hole 51. The capping portion 61 can move the cap 62 up and down along the Z axis via the through hole 51. Moreover, when the platen 50 is viewed sideways as shown in FIG. 2, or in other words, when the support surface 55 of the platen 50 is viewed in the +Y direction being a direction to transport the sheet S, the cap 62 and the platen 50 are disposed in an overlapping manner. In this way, it is possible to form the printer 1 compactly while securing the printing region for ejecting the droplets from the ejection head 40 onto the sheet S.

The following effects are available from the above-described embodiment.

The one end portion 21*a* of the guide shaft 21 that supports the carriage 20 and the one end portion 50*a* of the platen 50 are fixed to the first frame 201. Meanwhile, the other end portion 21*b* of the guide shaft 21 and the other end portion 50*b* of the platen 50 are fixed to the second frame 202. In other words, the guide shaft 21 and the platen 50 are fixed to the paired frames identical to each other. Accordingly, when the printer 1 receives vibration, an impact, and the like during its transportation, for example, the first frame 201 and the second frame 202 are deformed likewise through the guide shaft 21 and the platen 50. Thus, an interval between the guide shaft 21 and the platen 50 is kept constant. As a consequence, it is possible to retain a constant interval between the nozzle surface 40*a* of the ejection head 40 supported by the guide shaft 21 and the support surface 55 of the platen 50.

Here, in this embodiment, the first frame 201 and the second frame 202 are coupled to a rear surface frame provided in the −Y direction of the body frame 2 or to a bottom surface frame provided in the −Z direction of the body frame 2. Accordingly, when the printer 1 receives vibration, an impact, and the like during its transportation, the first frame 201 and the second frame 202 are also possibly deformed through the rear surface frame and the bottom surface frame in addition to the guide shaft 21 and the platen 50.

Moreover, the rigidity of the guide shaft 21 is equal to the rigidity of the platen 50. Accordingly, when the printer 1 receives vibration, an impact, and the like during its transportation, the first frame 201 and the second frame 202 are prone to be deformed likewise. Hence, the interval between the ejection head 40 and the platen 50 can be kept constant.

2. Second Embodiment

Figure 4:
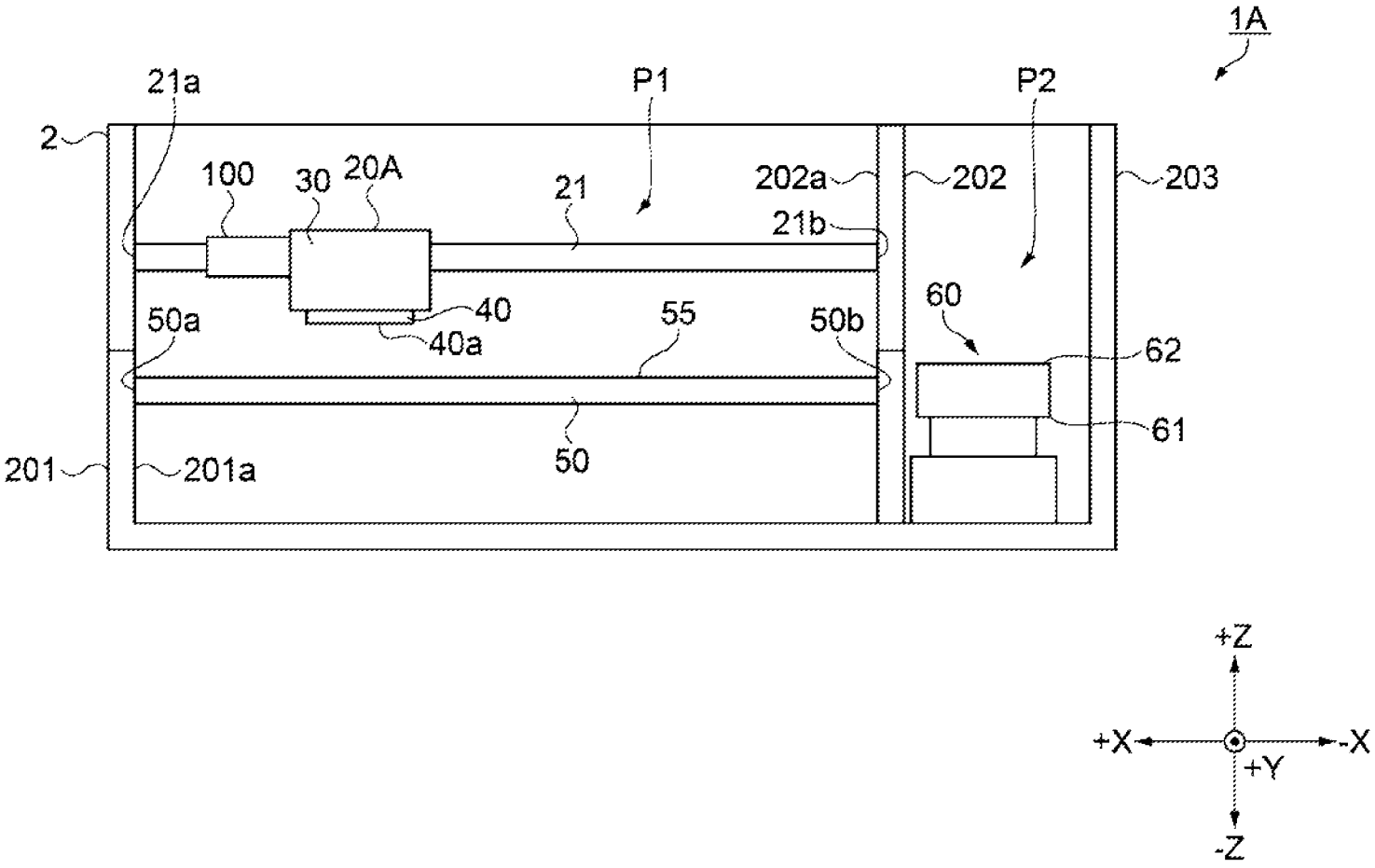
FIG. 4 is a schematic front view showing a configuration of a printer according to a second embodiment.
Figure 5:
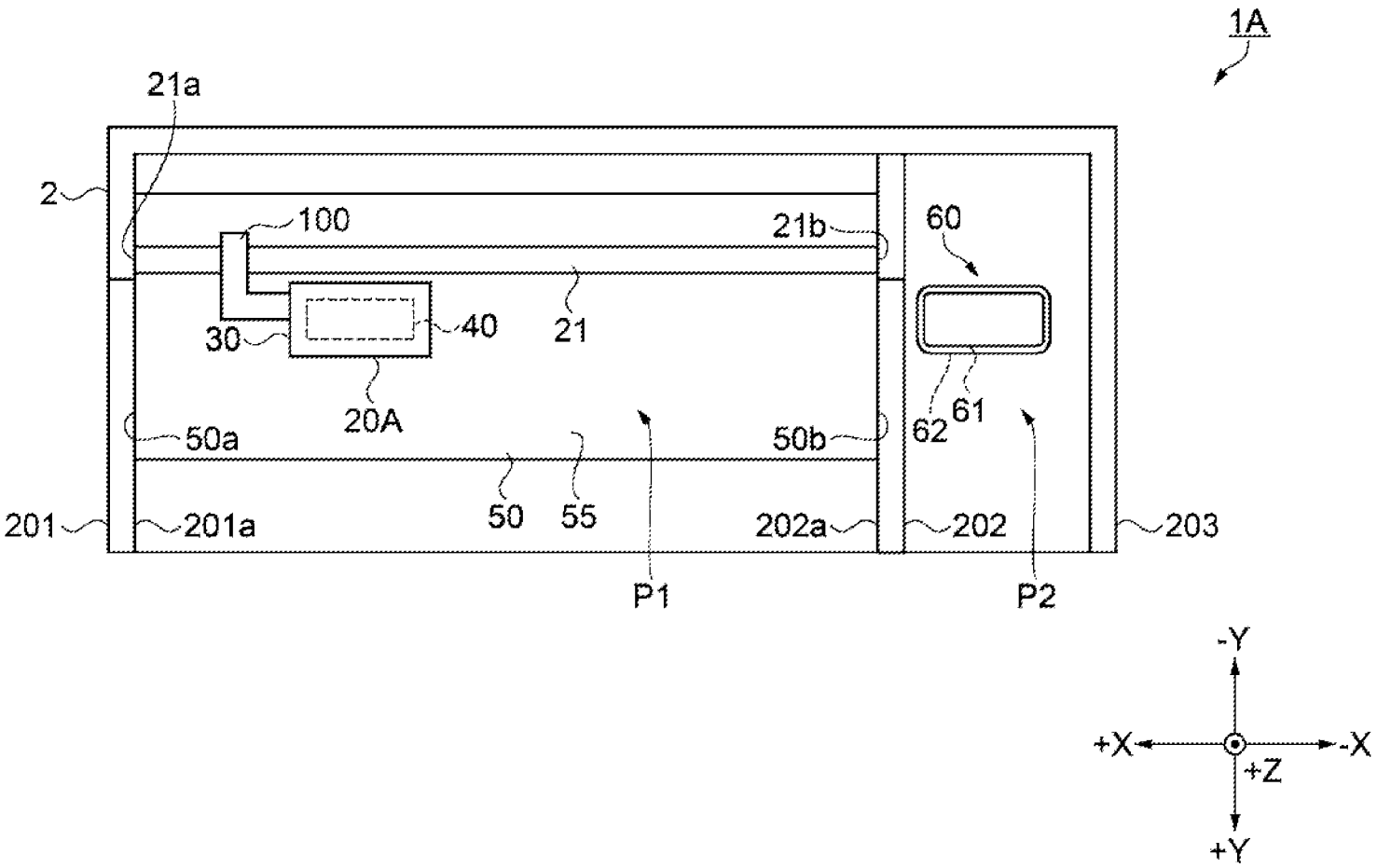
FIG. 5 is a schematic plan view showing the configuration of the printer according to the second embodiment.
Figure 6:
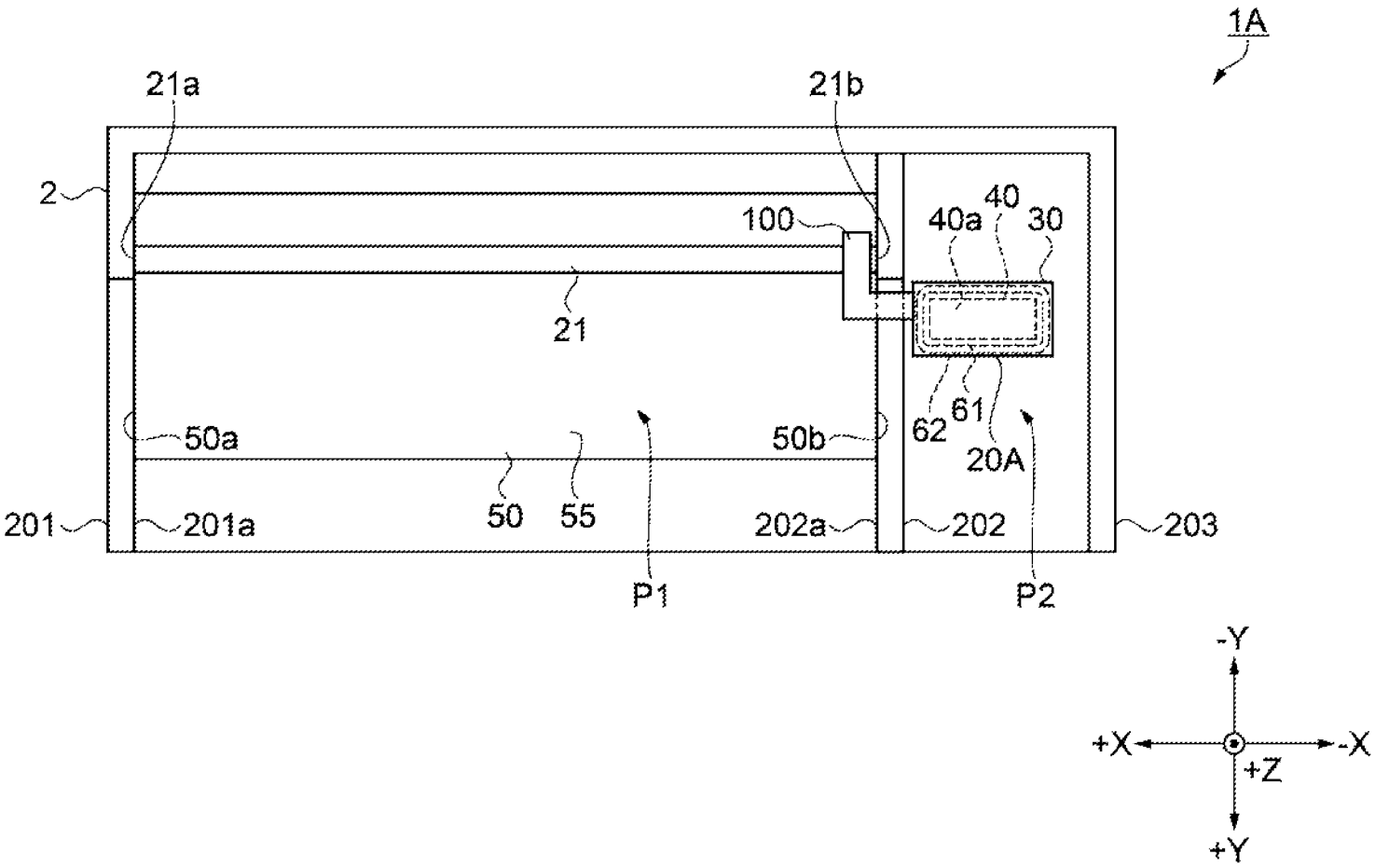
FIG. 6 is a schematic plan view showing a state of maintenance of an ejection head according to the second embodiment.

Next, a second embodiment will be described. FIG. 4 is a schematic front view showing a configuration of a printer 1A. FIG. 5 is a schematic plan view showing the configuration of the printer 1A. Meanwhile, FIG. 6 is a schematic plan view showing a state of maintenance of the ejection head 40.

As shown in FIGS. 4 and 5, the printer 1A includes the plate-like platen 50 provided with the support surface 55 for supporting a sheet S, the ejection head 40 that ejects inks as droplets, a carriage 20A that mounts the ejection head 40, the guide shaft 21 that supports the carriage 20A, the first frame 201, and the second frame 202. The one end portion 21*a* of the guide shaft 21 is fixed to the first frame 201. The other end portion 21*b* of the guide shaft 21 is fixed to the second frame 202. Meanwhile, the one end portion 50*a* of the platen 50 in the direction along the guide shaft 21 is fixed to the first frame 201 and the other end portion 50*b* of the platen 50 in the direction along the guide shaft 21 is fixed to the second frame 202. Moreover, the printer 1A includes the cap 62 that covers the nozzle surface 40*a* where the droplets are ejected from the ejection head 40.

Note that the features other than the configuration of the carriage 20A and the layout of the cap 62 are the same as those of the first embodiment, and description thereof will be omitted.

The cap 62 is disposed in a second region P2, which is a region different from the first region P1 between the first frame 201 and the second frame 202 and is provided in a direction along the X axis representing a direction of extension of the guide shaft 21. In this embodiment, the second region P2 is provided on the −X direction side of the second frame 202 and the cleaning portion 60 provided with the cap 62 is disposed in the second region P2. Meanwhile, a plate-like third frame 203 opposed to the second frame 202 is provided on the −X direction side of the cleaning portion 60. In other words, the cleaning portion 60 is disposed in the second region P2 as the different region from the first region P1 defined as the region where the guide shaft 21 and the platen 50 are disposed. In this embodiment, the first region P1 is the region between the first frame 201 and the second frame 202 in the direction along the X axis, while the second region P2 is the region between the second frame 202 and the third frame 203 in the direction along the X axis.

The carriage 20A includes an offset portion 100 that displaces a position of the nozzle surface 40*a* of the ejection head 40 in the direction toward the second region P2 relative to a position of a portion of the carriage 20A supported by the guide shaft 21. A section of the offset portion 100 is movably supported by the guide shaft 21. The offset portion 100 of this embodiment is an L-shaped member, which has a bent portion that is bent in the −X direction relative to the section of the offset portion 100 supported by the guide shaft 21 in plan view, and the attachment portion 30 is coupled to an end portion in the −X direction of the offset portion 100. The ejection head 40 is coupled to the attachment portion 30. Accordingly, in this embodiment, the position of the nozzle surface 40*a* of the ejection head 40 is offset on the −X direction side being the direction toward the second region P2 relative to the position of the section of the offset portion 100 supported by the guide shaft 21.

Moreover, as shown in FIG. 6, the nozzle surface 40*a* is located in the second region P2 in a state where the nozzle surface 40*a* is covered with the cap 62. In other words, in the state where the cap 62 covers the nozzle surface 40*a*, the offset portion 100 is located in the first region P1. However, since the ejection head 40 is offset in the −X direction by the offset portion 100, the nozzle surface 40*a* is located in the second region P2 beyond the second frame 202. In this way, when the ejection head 40 moves from the +X direction side to the −X direction side, the ejection head 40 goes beyond the first region P1 and moves to the second region P2, so that the nozzle surface 40*a* can be placed opposite to the cap 62 disposed in the second region P2. Here, a section of the second frame 202 which allows passage of the ejection head 40 is provided with a back clearance such as a clearance groove in order to avoid interference with the ejection head 40.

According to the above-described embodiment, the following effects are available in addition to the effects of the first embodiment.

The cap 62 is disposed in the second region P2 that is different from the first region P1 where the guide shaft 21 and the platen 50 are disposed. In this way, it is possible to simplify the structure of the platen 50 as compared to the relevant structure in the configuration to dispose the cap 62 in the same region as the region where the platen 50 is disposed. In addition, it is possible to calculate the rigidity of the platen 50 easily.

3. Modified Examples

Note that the present disclosure is not limited to the aforementioned embodiments, and various changes or improvements can be added to the aforementioned embodiments. Such modified examples will be discussed below.

First Modified Example

In the first embodiment, the cap 62 is disposed at the position corresponding to the −X direction of the platen 50. However, the present disclosure is not limited to this configuration. For example, the cap 62 may be disposed at a position corresponding to the +X direction of the platen 50. This arrangement can also achieve the same effects as those mentioned above.

Second Modified Example

In the second embodiment, the cap 62 is disposed on the −X direction side of the second frame 202. However, the present disclosure is not limited to this configuration. For example, the cap 62 may be disposed on the +X direction side of the first frame 201. In this case, the offset portion 100 shown in FIG. 5 is supported by the guide shaft 21 while inverting a direction of attachment of the offset portion 100 by 180° in plan view, for example. Then, the attachment portion 30 is coupled to the end portion in the +X direction of the offset portion 100 and the ejection head 40 is coupled to the attachment portion 30. In this way, the position of the nozzle surface 40*a* of the ejection head 40 is offset in the +X direction relative to the position of the section of the offset portion 100 supported by the guide shaft 21. This arrangement can also achieve the same effects as those mentioned above.

Third Modified Example

In the first and second embodiments, the first frame 201 and the second frame 202 are provided as part of the body frame 2. However, the present disclosure is not limited to this configuration. The first frame 201 and the second frame 202 may be provided separately from the body frame 2. This arrangement can also achieve the same effects as those mentioned above.

Fourth Modified Example

The first and second embodiments have described the configuration in which the distance dimension of the guide shaft 21 in the direction along the X axis is substantially equal to the distance dimension of the platen 50 in the direction along the X axis. However, the present disclosure is not limited to this configuration. For example, the distance dimension of the guide shaft 21 may be different from the distance dimension of the platen 50. This arrangement can also achieve the same effects as those mentioned above.

The following is a description of details derived from the embodiments.

A printer includes a platen that supports a print medium, an ejection head that ejects a liquid as a droplet toward the supported print medium, a carriage that mounts the ejection head, a guide shaft that movably supports the carriage, a first frame, and a second frame disposed opposite to the first frame. Here, one end portion of the guide shaft is fixed to the first frame and another end portion of the guide shaft is fixed to the second frame. Meanwhile, one end portion of the platen in a direction along the guide shaft is fixed to the first frame and another end portion of the platen in the direction along the guide shaft is fixed to the second frame.

According to this configuration, the one end portion of the guide shaft that supports the carriage and the one end portion of the platen are fixed to the first frame. Meanwhile, the other end portion of the guide shaft that supports the carriage and the other end portion of the platen are fixed to the second frame. That is to say, the guide shaft and the platen are fixed to the paired frames identical to each other. Accordingly, when the printer receives vibration, an impact, and the like during its transportation, for example, the first frame and the second frame are deformed likewise through the guide shaft and the platen. For this reason, the interval between the guide shaft and the platen is kept constant. As a consequence, it is possible to retain a constant interval between the ejection head supported by the guide shaft and the platen.

The printer may include a cap disposed in a first region between the first frame and the second frame and configured to cover a nozzle surface of the ejection head to eject the droplet. Here, the cap and the platen may be disposed in an overlapping manner when the platen is viewed sideways.

According to this configuration, it is possible to form a printer compactly while securing a printing region for ejecting the droplet from the ejection head onto the print medium.

The printer may include a cap disposed in a second region, which is a region different from a first region between the first frame and the second frame and is provided in a direction of extension of the guide shaft, and configured to cover a nozzle surface of the ejection head to eject the droplet. Here, the carriage may include an offset portion configured to displace a position of the nozzle surface of the ejection head in a direction toward the second region relative to a position of a portion of the carriage supported by the guide shaft. The nozzle surface may be located in the second region in a state where the nozzle surface is covered with the cap.

According to this configuration, the cap is disposed in the second region different from the first region where the guide shaft and the platen are disposed. In this way, the structure of the platen is simplified, and a rigidity of the platen and the like can be easily designed.

In the printer, a rigidity of the guide shaft may be equal to a rigidity of the platen.

According to this configuration, when the printer receives vibration, an impact, and the like during its transportation, for example, the first frame and the second frame are prone to be deformed likewise. Thus, the interval between the ejection head and the platen can be kept constant.

What is claimed is:

1. A printer comprising:

a platen that supports a print medium;

an ejection head that ejects a liquid as a droplet toward the supported print medium;

a carriage that mounts the ejection head;

a guide member that movably supports the carriage; a first frame; and a second frame disposed opposite to the first frame, wherein a terminal end portion of the guide member is fixed to an inner side surface of the first frame and another terminal end portion of the guide member is fixed to another inner side surface of the second frame, and one end portion of the platen in a direction along the guide member is fixed to the first frame and another end portion of the platen in the direction along the guide member is fixed to the second frame.

2. The printer according to claim 1, further comprising:

a cap disposed in a first region between the first frame and the second frame and configured to cover a nozzle surface of the ejection head to eject the droplet, wherein the cap and the platen are disposed in an overlapping manner when the platen is viewed sideways.

3. The printer according to claim 1, further comprising:

a cap disposed in a second region which is a region different from a first region between the first frame and the second frame and which is provided in a direction of extension of the guide member, and configured to cover a nozzle surface of the ejection head to eject the droplet, wherein the carriage includes an offset portion that displaces a position of the nozzle surface of the ejection head in a direction toward the second region relative to a position of a portion of the carriage supported by the guide member, and the nozzle surface is located in the second region in a state where the nozzle surface is covered with the cap.

4. The printer according to claim 1, wherein a rigidity of the guide member is equal to a rigidity of the platen.

5. A printer comprising:

a platen that supports a print medium;

an ejection head that ejects a liquid as a droplet toward the supported print medium;

a carriage that mounts the ejection head;

a guide member that movably supports the carriage; a first frame; and a second frame disposed opposite to the first frame, wherein one end portion of the guide member is fixed to the first frame and another end portion of the guide member is fixed to the second frame, and one end portion of the platen in a direction along the guide member is fixed to the first frame and another end portion of the platen in the direction along the guide member is fixed to the second frame, wherein a rigidity of the guide member is equal to a rigidity of the platen.

6. The printer according to claim 5, further comprising:

a cap disposed in a first region between the first frame and the second frame and configured to cover a nozzle surface of the ejection head to eject the droplet, wherein the cap and the platen are disposed in an overlapping manner when the platen is viewed sideways.

7. The printer according to claim 5, further comprising:

a cap disposed in a second region which is a region different from a first region between the first frame and the second frame and which is provided in a direction of extension of the guide member, and configured to cover a nozzle surface of the ejection head to eject the droplet, wherein the carriage includes an offset portion that displaces a position of the nozzle surface of the ejection head in a direction toward the second region relative to a position of a portion of the carriage supported by the guide member, and the nozzle surface is located in the second region in a state where the nozzle surface is covered with the cap.

* * * * *